United States Patent [19]

Holland et al.

[11] Patent Number: 5,026,400

[45] **Date of Patent: * Jun. 25, 1991**

[54] BUILT PARTICULATE DETERGENT CONTAINING A NARROW RANGE ALCOHOL ETHOXYLATE AND A PET-POET COPOLYMER SOIL RELEASE AGENT

[75] Inventors: Richard J. Holland, Trenton; Charles Buda, Middlesex, both of N.J.

[73] Assignee: Colgate-Palmolive Company, Piscataway, N.J.

[ * ] Notice: The portion of the term of this patent subsequent to Nov. 28, 2006 has been disclaimed.

[21] Appl. No.: 445,565

[22] Filed: Dec. 4, 1989

Related U.S. Application Data

[63] Continuation of Ser. No. 84,524, Aug. 10, 1987, Pat. No. 4,908,039.

[51] Int. Cl.[5] ..... C11D 1/72; C11D 3/37; C11D 11/00; D06M 15/507

[52] U.S. Cl. ..... 8/137; 252/174.21; 252/174.22; 252/174.13; 252/174.24; 252/135; 252/174; 252/91; 252/8.9; 252/DIG. 1; 252/DIG. 2; 252/DIG. 15

[58] Field of Search ..... 252/174.21, 174.22, 252/174.13, 174.24, DIG. 1, DIG. 2, DIG. 15, 135, 174, 8.9, 91; 8/137

[56] References Cited

U.S. PATENT DOCUMENTS

| | | | |
|---|---|---|---|
| 3,682,849 | 8/1972 | Smith | 252/135 |
| 4,132,680 | 1/1979 | Nicol | 252/135 |
| 4,441,881 | 4/1984 | Ruppert et al. | 252/174.21 |
| 4,474,678 | 10/1984 | Lutz et al. | 252/174.21 |
| 4,549,977 | 10/1985 | Joshi et al. | 252/135 |
| 4,564,463 | 1/1986 | Secemski et al. | 252/174.21 |
| 4,571,303 | 2/1986 | Ciallella | 252/174.23 |
| 4,883,610 | 11/1989 | Ciallella | 252/174.21 |
| 4,908,039 | 3/1990 | Holland et al. | 252/174 |

*Primary Examiner*—Prince E. Willis
*Assistant Examiner*—James Silbermann
*Attorney, Agent, or Firm*—Bernard Lieberman; Murray M. Grill; Robert C. Sullivan

[57] ABSTRACT

Narrow range ethoxylate nonionic detergents, in combination with coil release promoting polyethylene terephthalate-polyoxyethylene terephthalate (PET-POET) copolymer (in place of broad range ethoxylate nonionic detergent and PET-POET copolymer) are of significantly and unexpectedly improved soil release promoting activity in built synthetic organic detergent compositions, of either the phosphate-built or non-phosphate-built types. Preferably, there will be present with the PET-POET copolymer a stabilizing proportion of polyacrylate, to stabilize the PET-POET copolymer against deterioration and loss of soil release promoting activity on storage at elevated temperature, especially when in contact with alkaline components of the detergent composition. The improved soil release promoting activity is most pronounced when the laundry to be washed and treated is subjected to repeated launderings with the invented compositions in cold water and when it includes polyester-containing fibrous materials.

15 Claims, No Drawings

BUILT PARTICULATE DETERGENT CONTAINING A NARROW RANGE ALCOHOL ETHOXYLATE AND A PET-POET COPOLYMER SOIL RELEASE AGENT

This is a continuation of application Ser. No. 084,524, filed Aug. 10, 1987, now U.S. Pat. No. 4,908,039.

This invention relates to built particulate nonionic synthetic organic detergent compositions of improved soil release promoting properties. More particularly, it relates to such detergent compositions which comprise soil release promoting polyethylene terephthalate-polyoxyethylene terephthalate (PET-POET) copolymer as a soil release promoting agent, builder for the nonionic detergent, and narrow range ethoxylate (NRE) nonionic detergent, which functions as a detergent, but which also significantly improves the soil release promoting effect of the PET-POET copolymer.

The improved soil release promoting activity of the described compositions is most pronounced when laundry being washed (and being simultaneously treated with soil release promoting agent) is of a fabric(s) which include(s) synthetic organic polymeric fibrous material(s), especially polyester(s), and when washing is at low temperature, e.g., 10 to 30° or 15 to 25° C. Preferably, a polyacrylate, such as sodium polyacrylate, is also present in the detergent composition, to stabilize the PET-POET copolymer, with which it is maintained in intimate contact.

Prior to the present invention it was known to make built synthetic organic detergent compositions, utilizing nonionic detergents and phosphate and/or non-phosphate builders. The non-phosphate builders that have been employed include both water soluble and water insoluble builders. The soluble include alkali metal silicates, carbonates, bicarbonates, and borates, and the water insoluble builders include zeolites, all of which are well known in the art. Such compositions are described in a number of U.S. patents issued to the assignee of the present application, Colgate-Palmolive Company, and products of this type, wherein spray dried base beads of builder salt have nonionic detergent, in liquid state, absorbed into them, have been marketed by that company under the trademark FRESH START.

PET-POET polymers have been suggested as components of detergent compositions in which they help to promote the release of later applied soils from laundry. Patents describing such polymers and such function thereof include British patent specification 1,088,984 and U.S. Pat. No. 3,962,152.

U.S. Pat. No. 3,962,132 discloses polyacrylates in zeolite-built detergent compositions and U.S. patent 4,283,299 discloses polyacrylate in phosphate-built nonionic detergent compositions for its antiredeposition function.

U.S. Pat. No. 4,441,881 discloses NRE nonionic detergent compositions containing builder and a small proportion of modified cellulose ether, such as hydroxypropylmethyl cellulose or methyl cellulose as "soil shields". In such patent the nonionic detergent described is a higher fatty alcohol narrow range polyethoxylate (NRE) nonionic detergent which is taught to be less likely to smoke or fume off from the top of a spray tower when a cruteher mix containing such nonionic detergent is spray dried. The '881 patent also mentions that the NRE thereof, in the compositions described in the patent, made such compositions superior in cleaning ability to similar compositions in which conventional, or broad range ethoxylates (BRE's) were employed as nonionic detergents. Please note that in the preceding sentence, and subsequently, to save repetition of "nonionic detergent", NRE and BRE refer to such detergent, not to only the types of ethoxy moieties thereof.

U.S Pat. Nos. 4,569,772 and 4,571,303 both describe compositions similar to those of the present invention, with the exception that neither of such patents mentions NRE's and neither discloses nor suggests that employing NRE's instead of BRE's in such compositions would synergistically improve the soil release promoting characteristics of the PET-POET copolymer in such compositions.

In searches for art relevant to the present invention, relates to various combinations of the required components of the invented compositions, it does not teach one of ordinary skill in the art to employ NRE's instead of BRE's in built detergent compositions that contain PET-POET soil release promoting polymers, with or without polyacrylate stabilizer, and certainly such art would not teach or suggest that applicants' claimed compositions would be of improved soil nonionic detergents instead of BRE nonionic detergents.

In accordance with the present invention a soil release promoting built particulate detergent composition of improved soil release promoting properties in cold water washing of polyester-containing fabrics that have been soiled with oily soils, which improved soil release is due to the presence therein of narrow range ethoxylate (NRE) nonionic detergent and soil release promoting polyethylene terephthalate-polyoxyethylene terephthalate (PET-POET) copolymer instead of broad range ethoxylate (BRE) nonionic detergent and PET-POET copolymer, comprises a detersive proportion of such a NRE type of a nonionic detergent, which is a polyethoxylated lipophile, ethoxylated with an average of 5 to 10 ethylene oxide groups per mole, and with at least 70% of the ethylene oxide being in polyethoxy groups of 4 to 12 ethylene oxides, a building proportion of builder for the nonionic detergent, and a soil release promoting proportion of PET-POET copolymer soil release promoting agent. Also within the invention is a method of washing laundry and imparting soil release promoting properties to it by repeated washing of such laundry with the invented composition. Preferably, such composition includes a polyacrylate stabilizer for the PET-POET copolymer and the method also includes using such polyacrylate-stabilized compositions.

The active detergent constitutent of the present compositions and methods is primarily a nonionic detergent. Anionic synthetic organic detergents may tend to inactivate PET-POET copolymers or can inhibit soil release promotion by them, probably by interfering with the deposition of such copolymers from the wash water onto the laundry. However, anionic detergents may sometimes be employed in small proportions in essentially nonionic detergent compositions without having too detrimental an effect on soil release promotion by the PET-POET copolymer.

Of the nonionic detergents it is preferred to employ those which are reaction or condensation products of ethylene oxide and a suitable lipophile or lipophilic material. Higher alcohols, usually fatty alcohols of 12 to 18 carbon atoms per molecule, are the preferred reactants with ethylene oxide to make the desired nonionic detergents for the compositions of this invention, but Oxo-type alcohols and middle phenols, such as nonyl phenols, may also be useful. Other members of this well known class of nonionic detergents, such as higher fatty acid esters of ethylene oxide (NRE's) may also be useful in some compositions and for particular applications. Preferably a higher fatty alcohol is employed as the source of the lipophile and the product is a narrow range ethoxylate nonionic detergent. By narrow range ethoxylate is meant a polyethoxylated lipophile, ethoxylated with ethylene oxide so that at least 70% of the ethylene oxide in the nonionic detergent is in polyethoxy groups having n to (n+8) moles of ethylene oxide per mole, wherein n may be from 1 to 10, although it is preferable that n be 3 to 5, more preferably about 4. Thus, the narrow range ethoxylate (NRE) nonionic detergent has at least 70% of the ethylene oxide thereof in polyethoxy groups of 4 to 12 ethylene oxides. Most preferably, such groups are of 5 to 10 ethoxies and are at least 80 or 85% of the ethoxy content of the NRE's. Instead of ethylene oxide, in some cases mixtures of ethylene oxide and propylene oxide may be employed in such NRE's, providing that the final product has the desirable and unexpectedly beneficial properties, in conjunction with the PET-POET copolymer to be described in more detail later in this specification, so that soil release promotion is improved, compared to compositions containing the same PET-POET copolymer but employing broad range ethoxylate (BRE) nonionic detergent, the normal nonionic detergents of the art, instead. Although it may be preferred for the polyethoxylates of the NRE's to be within certain ranges of ethoxy contents in the polyethoxy moieties thereof, manufacturing methods usually result in mixtures of polymers, so average ethoxy contents may be specified. Thus, the NRE nonionic detergents may be of an average of 4 to 12 or 5 to 10 ethylene oxide groups per mole, e.g., averaging about 6 or 7 EtO's per mole. The preferred lipophile will be that from higher fatty alcohol and therefore the ethylene oxide content of the NRE nonionic detergents will be at least 70% of higher fatty alcohol ethoxylates averaging or of 5 to 10 ethylene oxide groups per mole and more preferably, at least 80 or 85% of the ethylene oxide will be in such higher fatty alcohol ethoxylates. This compares with about 50% or less of such polyethoxy groups in BRE's. Also, the higher fatty alcohol of the higher fatty alcohol ethoxylates will preferably be of 12 to 14 carbon atoms, although sometimes the fatty alcohol may be of 10 to 16 or 12 to 16 carbon atoms. It is within the invention to employ synthetic lipophiles, such as those derivable from higher fatty alcohols of odd numbers of carbon atoms in the ranges given, or those derivable from higher fatty alcohols of even numbers of carbon atoms, as in natural products, and mixtures thereof may also be utilized. NRE's that are presently available are preferably manufactured by catalyzed condensation reactions which promote the production of a narrow range of polyethoxylates, rather than the more conventional broad range of polyethoxylates in the alkoxylated lipophile detergent. Products produced catalytically are characterized by a normal distribution curve when ethylene oxide content (abscissa) is plodded against weight percent (ordinate) but the peak of the "bellshape" curve is much higher for the NRE than for the BRE nonionic detergents. Similar products, of similar distribution curves may be made by "topping" and "bottoming" BRE's or other NRE's, by removing higher and lower polyethoxylates by solvent extractions, distillations and other suitable physical processes. The BRE nonionic detergents will include lower percentages of a narrow range of desired polyethoxylates, such as those of 4 to 12 or 5 to 10 EtO's, often less than 50%, compared to more than 70% for the NRE's. They will also include at least about 1% of all unit degrees of ethoxylation from 1 to 16 or 1 to 2 even when it is desired to have the average or mean ethylene oxide content at 7 moles per mole. On the other hand, the NRE which averages 7 moles of EtO per mole will usually have no higher polymer of ethylene oxide than 15, and the proportions of polyoxyethylene in the 4 to 12 and 5 to 10 EtO ranges will be significantly increased. Such increase and the narrower distribution range of the polyethoxy moieties apparently changes the properties of the NRE for the better when it is included in a detergent composition with PET-POET copolymer. The reason for this effect is not fully understood at present but it may be related to a lesser interference of the nonionic detergent with the laying down of the PET-POET copolymer on the laundry substrate, prior to soiling and ultimate removal by subsequent washing. Within the "peak" area of an NRE curve, as from 5 to 10 ethoxy groups per polyoxyethylene moiety, the percentages of the 5 to 10 EtO moieties for the NRE's, compared to BRE's, may range from 15% more to 60% more, with the peak differences being for the 7 and 8 EtO polyethoxylates Among the preferred NRE nonionic detergents employable in accordance with the present invention is Tergitol ® Nonionic Surfactant 24-L-60N, which is of the formula $RO(CH_2CH_{20})H$, wherein R is a mixture of $C_{12}$ and $C_{14}$ linear alcohols and n averages about 7.0. Such product has a cloud point of 60° C. for a 1% aqueous solution and is a narrow range ethoxylate. Its properties are described in a product information bulletin issued by the manufacturer, Union Carbide Corporation, which carries the date of April, 1987. In place of Tergitol Nonionic Surfactant 24-L-60N there may be also be employed similar products manufactured by Shell Chemical Company, which have been identified as Shell ®23-7P and Shell 23-7Z.

The PET-POET copolymers useful in the practice of the present invention arc available from Alkaril Chemicals, Inc. in powder or aqueous dispersion form, as Alkaril ®QCF and Alkaril QCJ. Such copolymers which also contain polyacrylate stabilizer (usually in 4:1 copolymer : polyacrylate weight ratio), are supplied by such company under the names Alkaril Base C and Alkaril Velvetol 251-C.

Various builders and combinations thereof which are effective to complement the washing action of the nonionic synthetic organic detergent(s) and to improve such action include both water soluble and water insoluble builders. Of the water soluble builders, both inorganic and organic builders may be useful, but the inorganics are preferred, usually as alkali metal salt(s). Among the water soluble inorganic builders those of preference include: various phosphates, usually polyphosphates, such as the tripolyphosphates and pyrophosphates, more specifically the sodium tripolyphosphates and sodium pyrophosphates, e.g., pentasodium tripolyphosphate, tetrasodium pyrophosphate; sodium carbonate; sodium bicarbonate; sodium silicate; sodium borate or borax; and mixtures thereof. Instead of a mixture of sodium carbonate and sodium bicarbonate, sodium sesquicarbonate will sometimes be substituted. The alkali metal or sodium silicate, when employed is normally of $M_2O:SiO_2$ or $Na_2O:SiO_2$ ratio within the range of 1:1.6 to 1:3, preferably 1:2.0 to 1:2.8, e.g., 1:2.4 (or 1:2.35).

Of the water soluble inorganic builder salts, when phosphates arc not objectionable they may be employed, sometimes with a lesser proportion of sodium silicate. In preferred non-phosphate compositions carbonates may be employed with bicarbonate, and sometimes with borate and/or a lesser proportion of sodium silicate. Silicates will rarely be used alone. Instead of individual polyphosphates being utilized it may sometimes be preferred to employ mixtures of sodium tripolyphosphate and sodium pyrophosphate in proportions within the range of 1:10 to 10:1, preferably 1:5 to 5:1. Of course, it is recognized that changes in phosphate chemical structure may occur during crutching and spray drying so that the final product may differ in phosphate content somewhat from the phosphate components charged to the cruteher, which are those set forth in the present description. Although sometimes water soluble organic builders may be employed too, such as trisodium nitrilotriacetate (NTA), water soluble inorganic builders are generally preferred, as was previously indicated. The various water soluble builder salts may be utilized in hydrated forms, which are sometimes preferred, and the water soluble builders, hydrated or anhydrous, will normally be sodium salts, or mixtures of alkali metal salts, but sodium salts are usually preferred. In some instances, as when neutral or slightly acidic detergent compositions are being produced, acid forms of the builders may be preferable but normally the salts will either be neutral or basic in nature, and usually a 1% aqueous solution of the detergent composition will be of a pH in the range of 9 to 11.5, e.g., 9 to 10.5.

Insoluble builders, generally of the Zeolite A type, usually hydrated, as with 15 to 25% of water of hydration, may be used advantageously in the compositions of the present invention. Hydrated Zeolites X and Y may be useful too, as may be naturally occurring zeolites and zeolite-like materials and other ion-exchanging insoluble compounds that can act as detergent builders. Of the various Zeolite A products, Zeolite 4A may often be found to be preferred. Such materials are well known in the art and methods for their manufacture need not be described here. Usually such compounds will be of the formula $$(Na_2O)_x \cdot (Al_2O_3)_y \cdot (SiO_2)_z \cdot w\ H_2O$$

wherein x is 1, y is from 0.8 to 1.2, preferably about 1, z is from 1.5 to 3.5, preferably 2 to 3 or about 2, and w is from 0 to 9, preferably 2.5 to 6.

The zeolite builder should be a univalent cation exchanging zeolite, i.e., it should be an aluminosilicate of a univalent cation such as sodium, potassium, lithium (when practicable) or other alkali metal, or ammonium. Preferably the univalent cation of the zeolite type mentioned is an alkali metal cation, especially sodium or potassium and most preferably it is sodium, as was indicated in the preceding formula. The zeolites, whether crystalline or amorphous, are capable of reacting sufficiently rapidly with calcium other water softening compounds in the detergent composition, they soften the wash water before adverse reactions of water hardness ions with other components of the synthetic organic detergent composition occur. The zeolites employed may be characterized as having a high exchange capacity for calcium ion, which is normally from about 200 to 400 or more milligram equivalents of calcium carbonate hardness per gram of the aluminosilicate, preferably 250 to 350 mg. eg./g., on an anhydrous zeolite basis. Also they preferably reduce the hardness quickly in wash water, usually within the first 30 seconds to five minutes after being added to the wash water, and they can lower the hardness to less than a milligram of $CaCO_3$ per liter within such time. The hydrated zeolites will normally be of a moisture or water of hydration content in the range of 5 to 30%, preferably about 15 to 25% and more preferably 17 to 22%, e.g., about 20%. The zeolites, as charged to a cruteher mix from which base beads may be made, should be in finely divided state, with the ultimate particle diameters being up to 20 microns, e.g., 0.005 to 20 microns, preferably 0.01 to 8 microns mean particle size, e.g. 3 to 7 microns, if crystalline, and 0.01 to 0.1 micron, e.g., 0.01 to 0.05 micron, if amorphous. Although the ultimate particle sizes are much lower, usually the zeolite particles are of sizes within the range of No. 100 to 400 sieve, preferably No. 140 to 325 sieve, as charged to the crutcher for the manufacture of the base beads. In the base beads the zeolite(s) will often desirably be accompanied by a suitable builder salt or salts, e.g., sodium tripolyphosphate and sodium silicate (in relatively minor proportion), or sodium carbonate and sodium bicarbonate. Sodium silicate may tend to agglomerate with zeolites so the proportion thereof present in zeolite-built base beads may be limited, or the sodium silicate may be omitted, especially from the carbonate-containing formulations, but sometimes as much as 10% may be present in the final detergent compositions, such as when no other suitable binder or anticorrosion agent is present.

The PET-POET copolymers of this invention will usually be of molecular weights in the range of 19,000 to 43,000, more preferably being about 19,000 to 25,000, e.g., about 22,000, according to molecular weight determinations performed on samples thereof that are usually employed herein. Such molecular weights are weight average molecular weights, as distinguished from number average molecular weights, which, in the case of the present polymers, are often lower. In the polymers utilized the polyoxyethylene will usually be of a molecular weight in the range of about 1,000 to 10,000, preferably about 2,500 to 5,000, more preferably 3,000 to 4,000, e.g., 3,400. In such polymers the molar ratio of polyethylene terephthalate to polyoxyethylene terephthalate units (considering

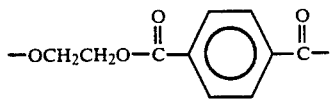

and

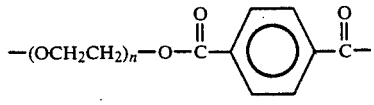

as such units) will be within the range of 2:1 to 6:1, preferably 5:2 to 5:1, more preferably 3:1 to 4:1, e.g., about 3:1. The proportion of ethylene oxide to phthalic moiety in the polymer will normally be at least 10:1 and often will be 20:1 or more, preferably being within the range of 20:1 to 30:1, and more preferably being about 22:1. Thus, it is seen that the polymer may be considered as being essentially a modified ethylene oxide polymer with the phthalic moiety being only a minor component thereof, whether calculated on a molar or weight basis. It was considered surprising that with such a small proportion of ethylene terephthalate or polyethylene terephthalate in the copolymer, such copolymer is sufficiently similar to the polymer of the polyester fiber substrate (or other polymers to which it is adherent, such as polyamides) as to be retained thereon during washing, rinsing and drying operations.

Although the described PET-POET copolymer is that which is employed normally by applicants, in accordance with the present invention, and that which is highly preferred for its desired functions, other PET-POET polymers, such as those described in the previously mentioned U.S. and British patents, may also be employed and can be effective soil release promoting agents in the compositions and methods of this invention. However, the soil release promoting properties of such materials may not be as good as those of the preferred polymers.

The polyacrylate used to stabilize the PET-POET copolymer is a low molecular weight polyacrylate, such as alkali metal polyacrylate, e.g., sodium polyacrylate, the molecular weight of which is usually within the range of about 1,000 to 5,000, preferably being in the range of 1,000 to 3,000 and most preferably being between 1,000 and 2,000, e.g., about 2,000. The mean molecular weight will usually be within the range of 1,200 to 2,500, such as 1,300 to 1,700. Although other water soluble polyacrylates may sometimes be substituted in part for the described sodium polyacrylate, including some other alkali metal polyacrylates, e.g., potassium polyacrylate, it is preferred that such substitutions, when permitted, be limited to a minor proportion of the material, and preferably, the polyacrylate employed will be an unsubstituted sodium polyacrylate. Such materials are available from Alco Chemical Corporation, under the name Alcosperse®. The sodium polyacrylates are available as clear amber liquids or powders, completely soluble in water, with the solutions being of about 25 to 40% solids contents, e.g., 30%, and with the pH of such solution or of a 30% aqueous solution of a powder being in the range of 7.5 to 9.5. Among these products those preferred are presently sold as Alcosperse 104, 107, 107D, 109 and 149, of which Alcosperse 107D, a 100% solids powder, is highly preferred, although Alcosperse 107, a 30% aqueous solution, may be used instead, with little difference in results (provided that it is dried first). Both are sodium: polyacrylates with the liquid (107) being of a pH in the 8.5 to 9.5 range and the pH of the powder (107D) being in the 7.0 to 8.0 range, at 30% concentration in water. The powder is preferably anhydrous but may contain a minor proportion of water, normally less than 10%, which is largely removed during any fusion operation practiced, as when the PET-POET copolymer and the polyacrylate are melted together and then cooled to solidification.

To make the stabilized soil release promoting polymer components of the invented compositions, following normal procedure, the PET-POET polymer is melted by being raised to a temperature above its melting point and preferably to a temperature in the range of 70° C. to 150° C., to liquefy it, and there is added to it powdered solid sodium polyacrylate. When a uniform melt has been obtained it may be cooled and the solidified mass may be size reduced by any suitable means. Preferably, cryogenic grinding or flaking operations will be employed so that the product will be a finely divided powder or flake which will be readily miscible with other particulate powder components of a built detergent composition and will not segregate objectionably from such composition. Cryogenic size reduction, often undertaken at a temperature below 0° C. and sometimes below −50° C., may be effected by grinding or otherwise size reducing in the presence of liquid nitrogen or other cryogenic material. Alternatively, a suitable grinder, such as a hammer mill, a cage mill or a Raymond Imp Mill may be employed, and instead of liquid nitrogen or other liquid cryogenic coolant, solidified carbon dioxide (dry ice) may be mixed with the resins being ground, or other cooling facilities may be utilized to prevent overheating of the material and to maintain it in cold, readily fracturable form. Instead of the mentioned size reduction devices, others of equivalent functions may be utilized, including the Raymond Ring-Roll Mill, which contains an internal separator and is capable of producing very finely divided resinous materials.

Instead of utilizing cryogenic or low temperature grinding equipment to size reduce the solidified melt of PET-POET and polyacrylate, the melt may be spray cooled to desirably sized beads, which will usually pass through a No. 10 sieve (U.S. Sieve Series), and preferably will pass through a No. 30 sieve.

The products resulting from application of the described processes of the present invention may be considered as PET-POET copolymer carrying polyacrylate. Because the proportion of the polyacrylate is relatively minor (although its effect is significant) the PET-POET copolymer provides a medium for distributing the polyacrylate throughout any detergent composition with which it is mixed. Thus, in addition to the stabilizing effect the polyacrylate has on the PET-POET copolymer, the polymer helps to extend the polyacrylate so that it may be more uniformly distributed throughout the detergent composition and thereby may more uniformly impart to such composition desirable properties of the polyacrylate, which include promotion of clay soil removal from laundry during washing and inhibition of soil redeposition onto the laundry during washing. The "carrying" of the polyacrylate by the stabilized polymer also obviates the need to spray the detergent composition beads or base beads with a solution of polyacrylate to distribute it more evenly throughout the detergent composition.

The stabilized PET-POET copolymers, with the preferred polyacrylate stabilizer in intimate contact therewith, are employed in the present invention for soil release promotion in the described detergent compositions. It has been found that laundry, especially laundry in which the fabrics are of polyesters or polyester blends of fibers (often with cotton), more readily release various soils to the wash water during washing with built synthetic organic detergent compositions, especially those based on nonionic detergents, if the soiling of the laundry takes place after it has been washed with such a detergent composition containing the PET-POET copolymer. Some of the copolymer is held to the laundry during the washing operation, so that it is present thereon when the laundry is subsequently soiled, and its presence promotes the removal of the later applied soil and/or stain during a subsequent washing. It might have been expected that the polyacrylate, in the same particles as the PET-POET copolymer, would promote dispersion of the polymer and inhibit deposition thereof on the laundry but such is not the case.

Instead, the polyacrylate increases the soil release promoting activity of the PET-POET polymer in detergent compositions. One mechanism accounting for this increase is the inhibition by the polyacrylate of decomposition or degradation of the polymer when it is subjected to contact with alkaline materials, as in such built detergent compositions in which the builder salt is alkaline (as many of them are), especially at elevated temperatures.

In addition to the NRE, builder and PET-POET copolymer, or in addition to the mentioned three components and polyacrylate stabilizer, the invented detergent compositions will usually also contain water (or moisture) and one or more adjuvants. A wide range of adjuvants may be employed, such as those which are normally present in detergent compositions of various types, but in the present compositions those adjuvants which are preferred include enzymes, such as mixed proteolytic and amylolytic enzymes, fluorescent brighteners, such as stilbene brighteners, colorants, such as dyes and pigments, crutching aids, such as citric materials and magnesium sulfate, and perfumes. In some instances fabric softeners, such as bentonite or quaternary ammonium halides or amines are employed and sometimes flow improving agents, which are often special clays, may be present. Bleaches, such as sodium perborate, and bleach activators, may be included in the present compositions, often in larger proportions than are employed of other adjuvants, and they will usually be most useful in detergent compositions intended for hot water washing. Fillers, e.g., $Na_2SO_4$, may also be present.

In the invented detergent compositions there will normally be present 10 to 35% of the NRE nonionic detergent, preferably 15 to 25% thereof and usually more preferably, about 20%. The builder content will usually be within the range of 30 to 75%, preferably 55 to 70% and most preferably about 58 to 61%, e.g., 58% and 61%. When the detergent composition is a phosphate-built composition the phosphate content will normally be in the range of 30 to 75%, with 0 to 10% of water soluble silicate, preferably 50 to 65% of sodium tripolyphosphate and 2 to 10% of sodium silicate, and more preferably about 58% of sodium tripolyphosphate and about 5% of sodium silicate. For the non-phosphate-built detergent compositions the contents of builders will normally be 30 to 75%, comprised of 15 to 40% of ion exchanging zeolite, 10 to 30% of sodium carbonate and 5 to 20% of sodium bicarbonate, preferably being 55 to 70% total, with 20 to 40% of zeolite, 15 to 25% of carbonate and 5 to 15% of bicarbonate, and more preferably being about 61% total builder, with 30% zeolite (anhydrous basis), 20% carbonate and 11% bicarbonate. The percentages of PET-POET copolymer for both types of detergent compositions will usually be in the range of 0.5 to 10%, preferably 2 to 6%, more preferably being about 4%, and the percentage ranges for the polyacrylate stabilizer will normally be in the range of 0.1 to 5%, preferably 0.5 to 5%,and more preferably will be about 1%. The proportion of sodium polyacrylate to PET-POET copolymer will normally be within the range of 1:6 to 1:2, preferably being 1:5 to 1:3,and more preferably will be about 1:4. The adjuvants present, except for bleaches and fillers, which may total 5 to 40% of the detergent composition, with the required components being reduced proportionately to compensate, will usually not exceed 10% of the composition, in total, and preferably will be less than 5% thereof, more preferably being in the range of 1 to 4%, e.g., 2% and 4%, for preferred phosphate-built and non-phosphate detergent compositions, respectively. Individual adjuvants (other than bleaches, bleach activators and fillers) will normally be less than 2% of the composition, often being less than 1.5% thereof.

To manufacture the present detergent compositions, base beads of inorganic builder are made by mixing together an aqueous cruteher mix of such builder or builder mixture, usually at a solids content in the range of 40 to 75%, at a temperature in the 40°-75° C. range, and spray drying it in a spray tower at a temperature in the range of 250° C. to 450° C., to produce substantially globular beads of particle sizes in the range of No's. 10 to 100, U.S. Sieve Series. If spray drying results in larger and smaller particles also being produced they may be screened or air classified to the desired range, or to another such range considered to be acceptable for the purpose intended. The spray dried beads, after cooling, then have nonionic detergent in liquid state absorbed therein, by spraying the desired nonionic liquid detergent, in the present case, NRE nonionic detergent, onto moving surfaces of the beads. An advantage of the present invention is that it has been found that the NRE's tend to be liquid or at least, near room temperature (25° C.) are more readily liquefied by heating than BRE's, and accordingly penetrate better into the interiors of the spray dried base beads, which improves processing and results in freer flowing products. The PET-POET copolymer may be dispersed and/or dissolved in the nonionic detergent and may be absorbed into the spray dried base beads with the nonionic detergent but, especially when polyacrylate stabilizer is employed to improve the soil release promoting properties of the PET-POET copolymer, the copolymer will be co-fused with the polyacrylate, after which the melt may be solidified, either by spray cooling to particles of sizes similar to those of the base beads, or may be cryogenically or otherwise suitably size reduced to such sizes. See U.S. Pat. No. 4,569,772 (Ciallella, assignor to Colgate-Palmolive Company) hereby incorporated by reference, for a more detailed description of the manufacture of the stabilized copolymer. The nonionic detergent-containing spray dried base beads and the stabilized copolymer may then be blended together and various other adjuvants, not previously incorporated into such components, may be post-added, by mixing and/or spraying, as may be appropriate. Usually, such adjuvants will include enzymes and perfumes, with flow improving agents being optional. Sometimes, antistatic agents will also be post-added, either as particulate solids or in liquid state. Such post-additions will normally be carried out in a suitable mixing apparatus, such as an inclined drum blender but usually any suitable type of blending apparatus may be employed.

The invented compositions are employed in essentially the same manner as has been described in U.S. Pat. No. 4,571,303 (Ciallella, assignor to Colgate-Palmolive Company), hereby incorporated by reference, and testing for suitability for commercial use is against a wide variety of stains encountered on normal laundry, including dirty motor oil, because a primary advantage of heavy duty or built nonionic detergent compositions is that they are effective in removing oily stains from laundry, especially laundry containing polyester fibrous materials. In testing for efficacy in such applications swatches of the material being tested, such as single knit polyester, double knit polyester, woven polyester and polyester/cotton blends, are prewashed, using a top loading automatic washing machine of 67 liter capacity, water at 150 p.p.m. hardness, as calcium carbonate (mixed calcium and magnesium hardness) in a regular ten minute wash cycle, after which the laundry is rinsed, spin dried and subsequently dried in an automatic laundry dryer (with a 30 minutes drying cycle) Next, the light reflectances of the swatches are read and averaged. Subsequently, the swatches are stained, as by dirty motor oil (usually three drops per swatch) and allowed to age overnight. The next day the reflectances of the stained areas of such fabrics are read and the swatches are washed and dried in the manner previously described, followed by readings of the reflectances of the previously stained areas.

If the reflectance of the unstained swatch is $Rd_1$ and that of the stained swatch before washing is $Rd_2$, with the final reflectance being $Rd_3$, the percentage of soil release is $[(Rd_3-Rd_2)/(Rd_1-Rd_2)]\times 100$. Of course, averages are taken for a plurality of swatches employed so that the average percentage of soil release for a particular stain on a particular material, for a variety of stains on such material, for a particular stain on a variety of materials or for a variety of stains on a variety of materials, may be found.

The soil release promoting activity of the detergent composition may thus be compared to that of another composition by comparing the percentages of soil release under identical washing conditions. Normally, cold water washing presents the most difficult test for a detergent composition and accordingly, comparisons under such conditions are considered to be more indicative of the activities of experimental detergent compositions, and such experimental compositions that remove stains and wash best in cold water are often those which are most preferred by consumers. Furthermore, cold water washing is energy conserving, less costly, and within reach of more people in both the industrialized and "3rd world" countries, so improved dirt and stain removals under such washing conditions are highly desirable.

By the test described above the NRE nonionic detergents of the present composition improve the soil release promoting effects of the PET-POET copolymer synergistically and significantly, compared to similar compositions in which BRE nonionic detergents replace the NRE components. In comparative tests, without the PET-POET copolymer being present the same types of detergent compositions show no superiority of the NRE nonionic detergent-containing compositions over the BRE compositions. Thus, it appears clear that the great improvement in soil release promoting effect of the invented compositions (and methods) is due to a coaction of the PET-POET copolymer soil release promoting agent and the NRE nonionic detergent, which coaction or synergism is not obvious from the prior art.

The following working examples illustrate but do not limit this invention, the scope of which is determined by the claims appended hereto. All parts and percentages in these examples, in this specification and in the claims are by weight and all temperatures are in ° C., unless otherwise indicated.

EXAMPLE 1

| Component | Percent |
|---|---|
| Sodium tripolyphosphate | 57.3 |
| *Narrow range ethoxylated higher fatty alcohol | 20.0 |
| Water | 10.0 |
| Sodium silicate ($Na_2O:SiO_2$ = 1:2.35) | 4.5 |
| **PET-POET copolymer | 3.6 |
| Mixed proteolytic and amylolytic enzymes (Maxatase ® MP) | 1.3 |
| Sodium sulfate | 1.1 |
| Fluorescent brightener (Tinopal ® 5BM Extra Concentrated) | 1.0 |
| Sodium polyacrylate (Alcosperse ® 107D) | 0.9 |
| Colorant (dye mixture) | 0.1 |
| Perfume | 0.2 |
| | 100.0 |

*Condensation product of $C_{12-14}$ linear alcohol and an average of 6 to 7 moles of ethylene oxide per mole of alcohol, with about 88% of the ethylene oxide being in polyoxyethylene groups of 5 to 10 EtO's (Tergitol 24-L-60N, mfd. by Union Carbide Corp.)

**PET-POET copolymer of weight average molecular weight of about 22,000, with molecular weight of the polyoxyethylene being about 3,400 and molar ratio of polethylene terephthalate to polyoxyethylene terephthalate units being about 3:1 Alkaril QCF, mfd. by Alkaril Chemicals, Inc., and supplied by them in particulate form, in 4:1 ratio, with sodium polyacrylate, as pre-fused Alkaril Base C.)

A particulate detergent composition of the above formula is made by crutching a 45% solids cruteher mix of the tripolyphosphate, silicate, sulfate, fluoreseent brightener and colorant, in tap water, at a temperature of about 60° C. and spray drying it into hot drying gas at a temperature of about 400° C. in a spray tower to form beads of sizes in the range of No's. 10 to 100, U.S. Sieve Series, having a moisture content of 13.5%. After cooling, 74 parts of such base beads are sprayed with 20 parts of the NRE nonionic detergent, in liquid state at elevated temperature, e.g., about 40° C., which detergent is absorbed into the beads. Then, 4.5 parts of a 4:1 QCF/Alcosperse blend (in particulate form, of approximately the same particle size as the spray dried beads) and 1.3 parts of the enzyme mixture are mixed with the builder-nonionic detergent beads and subsequently the product is perfumed with 0.2 part of liquid perfume being sprayed thereon, during all of which operations the materials are maintained in motion in an inclined drum mixer.

The soil release promoting effect of the described detergent composition, containing the synergistic combination of NRE nonionic detergent and PET-POET copolymer, is measured by the DMO (dirty motor oil) method previously described in this specification. Test swatches of different materials are first washed in an automatic washing machine with the experimental detergent composition, at a concentration of 0.15%, in 70° F. (21° C.) wash water of 150 p.p.m. hardness, as calcium carbonate, followed by automatic drying, staining of the test swatches with three drops of dirty motor oil (DMO) each, aging overnight, and washing again with the experimental detergent composition under the same conditions. Reflectances of the test swatches are read after the first washing, after staining, and after the second washing and the percentages of soil release are calculated according to the formula previously given.

A control composition is made wherein the same proportion of nonionic detergent is used, but it is a BRE (Neodol 25-7) of essentially the same average ethoxylate content and of essentially the same fatty alcohol component, with the only significant difference between the detergents being in the broad range distribution of the ethylene oxide polymer in the BRE detergent and the narrow range distribution thereof in the NRE detergent. For such control product the same base beads and adjuvants are employed, and in the same proportions but the different nonionic detergent is absorbed into such beads.

The following table compares the percentages of soil release (or stain removal) found:

TABLE I

| Swatch Fabric Type | Soil Released (%) Experimental | Control |
|---|---|---|
| Dacron double knit | 88.7 | 73.1 |
| Dacron single knit | 94.0 | 91.1 |
| Woven polyester | 91.5 | 80.8 |
| 65:35 Dacron:cotton blend | 47.3 | 35.7 |
| 50:50 Dacron:cotton blend | 32.2 | 26.7 |
| Nylon tricot | 79.4 | 59.4 |
| Acetate jersey | 81.9 | 72.1 |

Because a 5% difference in soil release is considered significant under the conditions of the test, significant differences were obtained for all the test swatches except the Dacron single knit, but even in that case the experimental is noticeably better than the control. The average improvement is 10.9%. Visual observations of the test swatches are even more convincing of the unexpectedly beneficial soil release promoting effect of the synergistic composition of this invention. It should be kept in mind that the test reported was run with more severe staining than is normally encountered and under washing conditions (cold water) that are considered adverse. Thus, even better soil release is obtainable when warm or hot wash water is employed. Also, when multiple washings, e.g., 2 to 6, with the compositions, precede the spotting with DMO the soil release promoting action of the invented composition is even more pronounced. The soil release actions obtained for DMO are also obtained when a variety of other oily type soils is employed in the described testing, and the improvements over controls are also of significance.

| Component | Percent |
|---|---|
| Sodium zeolite (Zeolite 4A, anhydrous basis) | 30.1 |
| Sodium carbonate (anhydrous) | 20.1 |
| *NRE nonionic detergent | 20.0 |
| Sodium bicarbonate | 10.8 |
| Water | 9.5 |
| White monomorillonite (anhydrous) | 1.4 |
| Enzyme mixture (Maxatase MP) | 1.3 |
| Fluorescent brightener (Tinopal 5BM Extra Concentrated) | 1.0 |
| **PET-POET copolymer | 4.0 |
| Sodium polyacrylate (Alcosperse 107D) | 1.5 |
| Perfume | 0.2 |
| Colorant (dye mixture) | 0.1 |
| | 100.0 |

*See Example 1
**See Example 1 (Alkaril Velvetol 251-C employed instead of Alkaril Base C.)

EXAMPLE 2

Two control compositions are made, A and B, with A being the same as the above experimental formula except for the substitution of Neodol 25-7 for Tergitol 24-L-60N, and with such BRE substitution also being made in control B, from which the QCF and stabilizing 1% of Alcosperse 107D are omitted (the balance of the Alcosperse 107D is added in the cruteher mix). Test swatches are washed, stained and washed again with the experimental, Control A and Control B compositions, respectively, and the results are compiled in the following table.

TABLE II

| Swatch Fabric Type | Soil Release (%) Experimental | Control A | Control B |
|---|---|---|---|
| Dacron double knit | 66.0 | 27.9 | 3.6 |
| 65:35 Dacron:cotton blend | 40.2 | 31.8 | 13.8 |
| Nylon tricot | 39.3 | 17.4 | 26.7 |
| Acetate jersey | 48.8 | 33.5 | 10.8 |

The above data show that the experimental formula of this invention is significantly better than either of the control formulas in promoting the release from the described test swatches of a more tenacious oily soil, an even dirtier motor oil than that used for the Example 1 tests. With a 5% difference being considered quite significant, it is evident that very noticeable differences are obtained compared to the better of the controls, in which a BRE nonionic detergent is employed instead of the NRE nonionic detergent of the present invented compositions. Thus, the average improvement in soil release for the four materials listed is 20.9%. Visual examinations of the test swatches confirm that the soil release promoting activity of the invented composition is far superior to those of the controls.

EXAMPLES 3 and 4

The compositions and controls of Examples 1 and 2, respectively, are made with an NRE nonionic detergent available from Shell Development Company , which identifies it as 23-7P, being substituted for Tergitol 24-L-60N. Swatch tests like those of Examples 1 and 2 show such detergent compositions to be essentially equivalent in soil release promoting actions to the experimental compositions of Examples 1 and 2, respectively, which establishes that Shell's 23-7P, which is within the scope of the description of the NRE's of the present invented compositions, also synergistically improves the soil release promoting activity of PET-POET copolymers in the present compositions.

EXAMPLES 5 and 6

The compositions and controls of Examples 1 and 2, respectively, are made with an NRE nonionic detergent available from Shell Development Company , which identifies it as 23-7Z, being substituted for Tergitol 24-L-60N. Swatch tests like those of Examples 1 and 2 show such to be essentially equivalent in soil release promoting actions to the experimental compositions of Examples 1–4, which establishes that Shell's 23-7Z, which is within the scope of the description of the NRE's of the present invented composition, also synergistically improves the soil release promoting activity of PET-POET copolymers in the present compositions. Similar results are obtainable by employing a Shell Development Company narrow range ethoxylate designated Neodol 23-6.5 NRE, which is the narrow range ethoxylate that may be compared to Neodol 23-6.5, a product of Shell Chemical Company (which product is a BRE). Also, mixtures of the mentioned substitute NRE nonionic detergents may be made, and comparable improvements in soil release promotion will be observed.

EXAMPLE 7

Various changes may be made in the compositions and methods of this invention without departing from it. Thus, in the washing operations the concentrations of detergent composition employed may be varied within the range of 0.05 to 0.3%, depending on wash water hardness and temperature, washing machine type and design, laundry type, and dirtiness of the laundry being treated and washed. Different builders, PET-POET polymers, polyacrylates, fillers, enzymes, and other adjuvants may be employed, as well as various mixtures thereof. Different mixtures of narrow range ethoxylate nonionic detergents may be employed and individual proportions of components of the invented detergent compositions may be changed ±10%, ±20% and ±30%, providing that they are within the ranges and deseriptions set forth in the specification. While anionic detergents will normally not be present in the invented compositions, their presence, up to a reasonable limit, say 10% of such a composition, may sometimes be desirable. Of the anionic detergents those which are most preferred are the linear higher alkyl benzene sulfonates, the higher fatty alcohol sulfates and higher fatty alcohol polyethoxy sulfates, preferably as sodium salts and with the alkyls and alcohols being of 10 to 18 carbon atoms, more preferably, of 12 to 14 carbon atoms.

When the modifications of the formulas of Examples 1-6 are made, as mentioned herein, the compositions resulting and the methods being practiced are effective in promoting soil release from various synthetic organic polymeric textiles (especially polyesters) and from synthetic/natural fiber blends. However, it is important that the nonionic detergents that are in such compositions and that are employed in such methods be of NRE type, as previously described, and be present in proportions within the ranges mentioned herein.

This invention has been described with respect to various working examples, illustrations and embodiments thereof but is not to be limited to these because it is evident that one of skill in the art, with the present specification before him, will be able to utilize substitutes and equivalents without departing from the invention.

What is claimed is:

1. A soil release promoting built particulate detergent composition of improved soil release promoting properties in cold water washing of polyester-containing fabrics that have been soiled with oily soils, which improved soil release is due to the presence therein of narrow range ethoxylate (NRE) nonionic detergent and soil release promoting polyethylene terephthalate-polyoxyethylene terephthalate (PET-POET) copolymer instead of broad range ethoxylate (BRE) nonionic detergent and PET-POET copolymer, which comprises a detersive proportion of such a NRE type of a nonionic detergent, which is a polyethoxylated lipophile, ethoxylated with an average of 5 to 10 ethylene oxide groups per mole, and with at least 70% of the ethylene oxide being in polyethoxy groups of 4 to 12 ethylene oxides, a building proportion of builder for the nonionic detergent, and a soil release promoting proportion of PET-POET copolymer soil release promoting agent.

2. A soil release promoting built particulate detergent composition according to claim 1 wherein the nonionic detergent is a condensation product of a higher fatty alcohol and ethylene oxide, with the ethylene oxide being in polyethoxy groups averaging 6 to 9 ethylene oxide groups per mole, and with at least 70% of the ethylene oxide being in higher fatty alcohol ethoxylates of 5 to 10 ethylene oxide groups per mole, the builder is an inorganic builder, and the PET-POET copolymer is of a weight average molecular weight in the range of 15,000 to 50,000.

3. A particulate detergent composition according to claim 2 wherein the higher fatty alcohol of the nonionic detergent is of 12 to 14 carbon atoms and is saturated, the builder is selected from the group consisting of sodium tripolyphosphate, sodium carbonate, sodium bicarbonate, sodium silicate, ion exchanging zeolite and mixtures thereof, the polyoxyethylene of the polyoxyethylene terephthalate of the PET-POET copolymer is of a molecular weight in the range of 1,000 to 10,000, and there is present in the detergent composition a stabilizing proportion of a polyacrylate stabilizer for the PET-POET copolymer, which inhibits degradation of the copolymer and accompanying loss of soil release promoting action, which otherwise occur as a result of storage at elevated temperatures and in the presence of alkaline materials.

4. A detergent composition according to claim 3 wherein over 85% of the ethylene oxide content of the narrow range ethoxylate nonionic detergent is present in $C_{12-14}$ higher fatty alcohol polyethoxylates of 4 to 12 ethylene oxide groups per mole and the nonionic detergent is 10 to 35% of the composition, the builder is 30 to 75% of the composition, the PET-POET copolymer is 0.5 to 10% of the composition, the polyacrylate is sodium polyacrylate and is 0.1 to 5% of the composition, and the proportion of sodium polyacrylate is 1/6 to ½ of the proportion of PET-POET copolymer.

5. A detergent composition according to claim 4 wherein over 85% of the ethylene oxide present in the $C_{12-14}$ higher fatty alcohol narrow range ethoxylate nonionic detergent is present in such detergent as polyethoxy groups of 5 to 10 moles of ethylene oxide per mole of such nonionic detergent.

6. A soil release promoting built particulate detergent composition according to claim 1 wherein the percentages of narrow range ethoxylate nonionic detergent, soil release promoting PET-POET copolymer, and builder are in the ranges of 10 to 35%, 0.5 to 10% and 30 to 75%, respectively, and the builder comprises 30 to 75% of alkali metal tripolyphosphate and 0 to 10% of water soluble alkali metal (M) silicate of $M_2O:SiO_2$ ratio in the range of 1:1.6 to 1:3, with such percentages and the $M_2O:SiO_2$ ratio being by weight of anhydrous material and on a final composition basis.

7. A detergent composition according to claim 5 wherein the percentages of narrow range ethoxylate nonionic detergent, soil release promoting PET-POET copolymer, builder and polyacrylate stabilizer for the PET-POET copolymer are in the ranges of 15 to 25%, 2 to 6%, 55 to 70%, and 0.5 to 5%, respectively, and the builder comprises 50 to 65% of sodium tripolyphosphate and 2 to 10% of sodium silicate of $Na_2O:SiO_2$ ratio of about 1:2.4, with such percentages and the $Na_2O:SiO_2$ ratio being by weight of anhydrous material and on a final composition basis.

8. A detergent composition according to claim 7 consisting essentially of about 20% of the higher fatty alcohol narrow range ethoxylate nonionic detergent, about 4% of the soil release promoting PET-POET copolymer, about 58% of sodium tripolyphosphate, about 5% of sodium silicate of $Na_2O:SiO_2$ ratio of about 1:2.4, about 1% of sodium polyacrylate, about 10% of water and about 2% of adjuvants and/or fillers.

9. A detergent composition according to claim 7 comprised of a mixture of spray dried base particles of sodium tripolyphosphate with or without sodium silicate therein, into which base particles the narrow range ethoxylate nonionic detergent has been absorbed, and particles of a solidified melt of PET-POET copolymer and polyacrylate stabilizer for such copolymer.

10. A soil release promoting, non-phosphate, built particulate detergent composition according to claim 1 wherein the percentages of narrow range ethoxylate nonionic detergent, soil release promoting PET-POET copolymer, and builder are in the ranges of 10 to 35%, 0.5 to 10% and 30 to 75%, respectively, and the builder comprises 15 to 40% of ion exchanging zeolite, 10 to 30% of sodium carbonate and 5 to 20% of sodium bicarbonate, with such percentages being by weight of anhydrous material and on a final composition basis.

11. A detergent composition according to claim 5 wherein the percentages of narrow range ethoxylate nonionic detergent, soil release promoting PET-POET copolymer, builder and polyacrylate stabilizer for the PET-POET copolymer are in the ranges of 15 to 25%, 2 to 6%, 55 to 70% and 0.5 to 5%, respectively, and the builder comprises 20 to 40% of hydrated Zeolite A, 15 to 25% of sodium carbonate and 5 to 15% of sodium bicarbonate, with all percentages being by weight of anhydrous material on a final composition basis.

12. A detergent composition according to claim 11 consisting essentially of about 20% of the higher fatty alcohol narrow range ethoxylate nonionic detergent, about 4% of the soil release promoting PET-POET copolymer, about 30% (anhydrous basis) of hydrated Zeolite A, about 20% of sodium carbonate, about 11% of sodium bicarbonate, about 1% of sodium polyacrylate, about 10% of water and about 4% of adjuvants.

13. A detergent composition according to claim 11 comprised of a mixture of spray dried base particles of hydrated Zeolite A, sodium carbonate and sodium bicarbonate into which base particles the narrow range ethoxylate nonionic detergent has been absorbed, and, particles of a solidified melt of PET-POET copolymer and polyacrylate stabilizer for such copolymer.

14. A method of washing laundry and imparting soil release promoting properties to it which comprises repeatedly washing such laundry in wash water containing a soil release promoting proportion of a soil release promoting built particulate detergent composition of claim 1.

15. A method according to claim 14 where the laundry comprises fibrous materials having polyester fibers in fabrics thereof and the laundry is subjected to repeated washings in cold water with the composition recited in claim 14, after intermediate soiling(s) of the fibrous material with oily soil(s).

* * * * *